US005882576A

United States Patent [19]

Shelleby et al.

[11] Patent Number: 5,882,576

[45] Date of Patent: Mar. 16, 1999

[54] INSULATING COVER FOR TORPEDO CARS

[75] Inventors: Robert A. Shelleby, Pittsburgh; Donald K. Wiseman, Jr., Cranberry Township, Butler County, both of Pa.

[73] Assignee: M.S.S.I., Inc., McKees Rocks, Pa.

[21] Appl. No.: 258,788

[22] Filed: Jun. 13, 1994

[51] Int. Cl.[6] ..... C21B 13/00

[52] U.S. Cl. ..... 266/44; 266/165; 266/272; 266/287

[58] Field of Search ..... 266/236, 165, 266/272, 287, 44; 294/65.5

[56] References Cited

U.S. PATENT DOCUMENTS

| | | | |
|---|---|---|---|
| 0,982,883 | 1/1911 | Schnabel | 294/65.5 |
| 1,466,823 | 9/1923 | Evans et al. | 294/65.5 |
| 2,828,762 | 4/1958 | Swank | 294/65.5 |
| 3,281,880 | 11/1966 | Bender | 294/65.5 |
| 4,381,855 | 5/1983 | Ryan | 266/248 |
| 4,390,170 | 6/1983 | Schaefer, IV et al. | 266/272 |
| 4,424,956 | 1/1984 | Grant et al. | 266/248 |
| 4,424,957 | 1/1984 | Grant et al. | 266/248 |
| 4,577,839 | 3/1986 | Carlson et al. | 266/272 |
| 4,726,568 | 2/1988 | Nicholson | 266/287 |

*Primary Examiner*—Scott Kastler
*Attorney, Agent, or Firm*—Webb Ziesenheim Bruening Logsdon Orkin & Hanson, P.C.

[57] ABSTRACT

An insulating cover for covering an opening in a torpedo car is disclosed. The insulating cover includes an upper and lower wire mesh layer and an insulating layer positioned between the wire mesh layers. Tie devices secure the wire mesh layers together and hold the insulating layer in position. At least one ferromagnetic plate is provided, whereby each ferromagnetic plate provides a lift point for lifting the insulating cover, such as with an electromagnet or the like.

19 Claims, 4 Drawing Sheets

INSULATING COVER FOR TORPEDO CARS

BACKGROUND OF THE INVENTION

1. Field of the Invention

The present invention relates to heat retention within torpedo cars, more specifically toward insulating covers which are configured for easy and safe positioning on torpedo cars.

2. Background Information

Torpedo cars, also referred to as ladle cars, are employed for carrying molten metal from one location to another. Typically, the hot metal is transported between the blast furnace and the melt facility by a torpedo car. After molten metal is poured from a torpedo car, it is desirable to retain the temperature within the container as high as possible between emptying and subsequent refilling of the torpedo car. The temperature retention is desired to minimize the molten metal temperature loss occurring during the next refilling.

It is well known to form a shield or insulating cover to cover the opening of a torpedo car such as a wire mesh enclosed refractory containing sheet. Examples of such insulating covers can be found in U.S. Pat. Nos. 4,381,855; 4,390,170; 4,424,956 and 4,424,957. These prior art insulating covers have several disadvantages including difficulty in manually engaging and positioning these covers on the torpedo car opening with hooks or the like.

It is the object of the present invention to overcome the drawbacks of these aforementioned prior art insulating covers by providing an easily manufactured insulating cover which is configured for easy placement and removal, if necessary, on the opening of a torpedo car.

SUMMARY OF THE INVENTION

The present invention provides an insulating cover for covering an opening in a torpedo car. The insulating cover of the present invention includes an upper wire mesh layer and a lower wire mesh layer with an insulating layer positioned between the upper and lower wire mesh layers. Tie devices secure the upper wire mesh layer and the lower wire mesh layer together and hold the insulating layer in position. Additionally, at least one ferromagnetic plate is coupled to the upper wire mesh layer, whereby each ferromagnetic plate provides a lift point for lifting the insulating cover, such as with an electromagnet or the like.

A plurality of support rods may be positioned between the upper and lower wire mesh layers so as to extend beyond the side edges of the upper and lower mesh layers. Each support rod has a length greater than the width of the torpedo car opening.

A pair of ferromagnetic plates may be provided with one of the plurality of support rods being positioned between each ferromagnetic plate and the lower wire mesh layer. In one embodiment of the present invention, each ferromagnetic plate is positioned on top of the upper wire mesh layer and includes a pair of support strips extending below the upper wire mesh layer and forming a locating hole on the underside of the ferromagnetic plate. A support rod will extend through the locating hole to couple the ferromagnetic plate to the upper wire mesh layer. The tie devices also secure each support rod into position. In a second embodiment of the present invention, each ferromagnetic plate is positioned between the upper wire mesh layer and the insulating layer with a portion of the upper wire mesh layer overlapping a portion of each ferromagnetic plate. The tie devices are provided adjacent each ferromagnetic plate to keep each ferromagnetic plate from moving, thereby coupling the ferromagnetic plate to the upper wire mesh layer.

The tie devices may include a plurality of wire ties extending through the insulating layer and securing the upper and lower wire mesh layers together. The insulating layer may extend beyond the peripheral edges of the upper and lower wire mesh layers, and may be formed of a ceramic fiber material. The insulating cover may be shaped to fit within the opening of the torpedo car such that the upper and lower mesh layers each include a pair of planar outer sections and a recessed central section. This formed configuration having the recessed central section will provide a better fit of the insulating cover within the opening of the torpedo car.

One embodiment of the present invention provides that the upper and lower mesh layers be substantially formed of 6"×6" wire grid with each of the ferromagnetic plates being a 12"×12" steel plate.

The insulating cover of the present invention provides an insulating cover which is easily manufactured according to the following steps. A lower wire mesh layer, upper wire mesh layer and an insulating layer positioned between the upper and lower wire mesh layers are positioned on a bending frame. The upper and lower wire mesh layers are bent on the bending frame whereby each upper and lower wire mesh layer will include a pair of planar outer sections and a recessed central section. At least one ferromagnetic plate is appropriately coupled to the upper wire mesh layer whereby each ferromagnetic plate will provide the lift point for lifting the insulating cover with an electromagnet or the like. The upper and lower wire mesh layers are secured together with tie means maintaining the insulating cover together.

These and other objects of the present invention will be clarified in the description of the preferred embodiments together with the attached drawings wherein like reference numerals indicate like elements throughout.

BRIEF DESCRIPTION OF THE PREFERRED EMBODIMENTS

Figure 1:
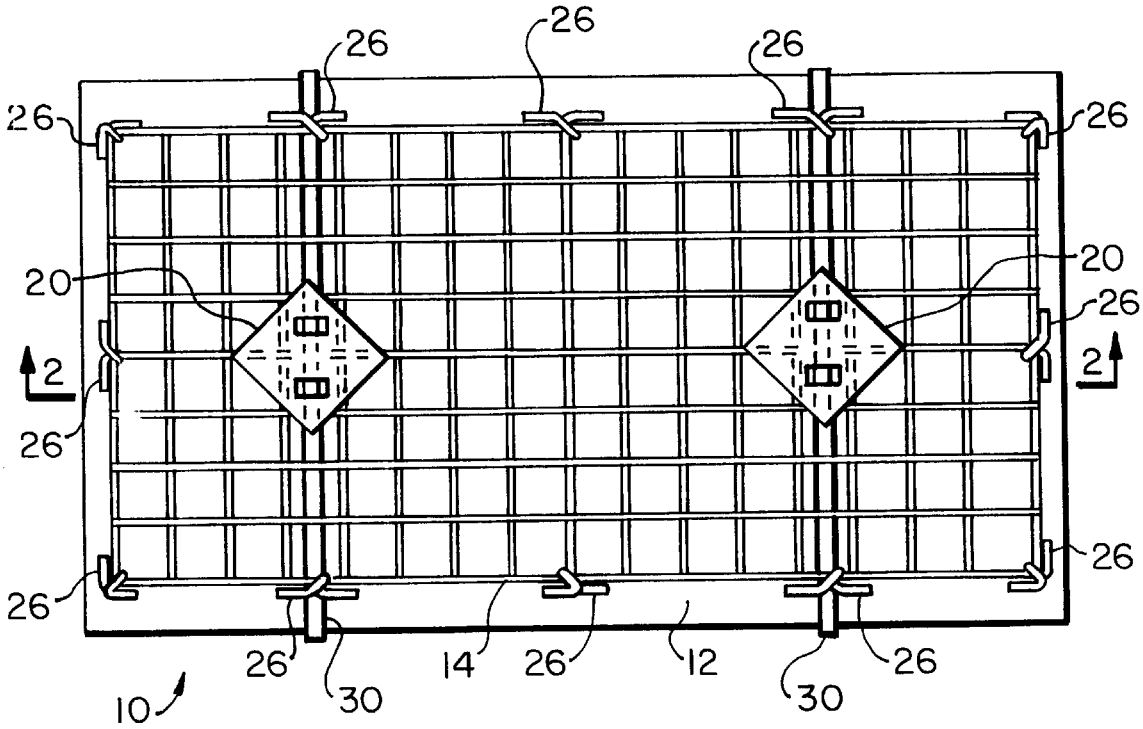
FIG. 1 is a top view of an insulating cover according to a first embodiment of the present invention.
Figure 2:
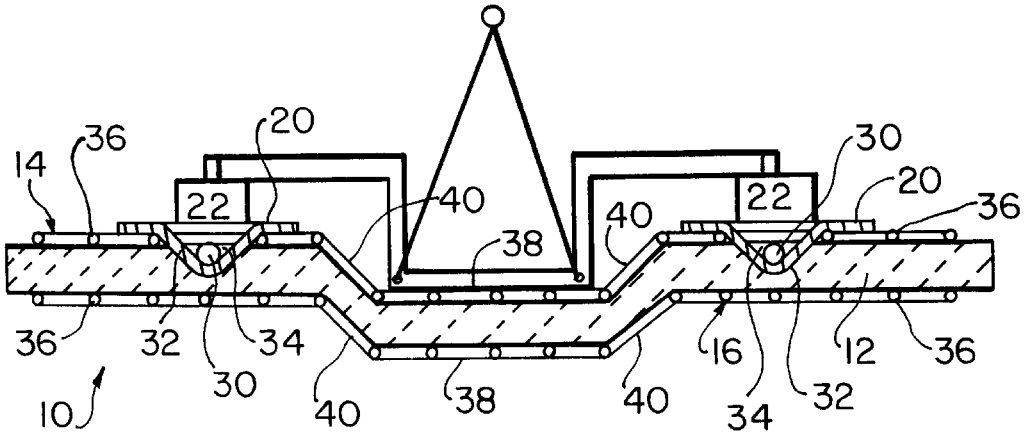
FIG. 2 is a sectional view taken along II—II of FIG. 1 showing the insulating cover illustrated in FIG. 1 together with electromagnets for holding and positioning the insulating cover.
Figure 3:
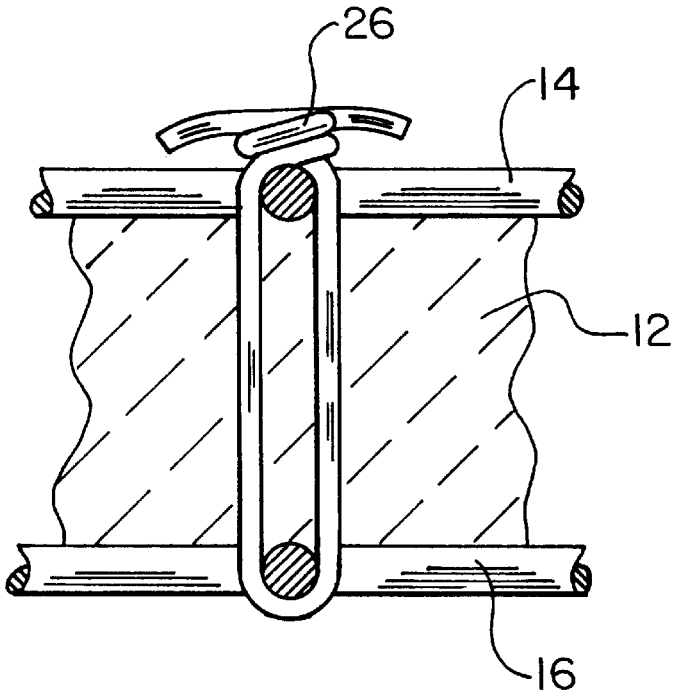
FIG. 3 is an enlarged view partially in section illustrating a wire tie of the insulating cover shown in FIGS. 1–2.

An insulating cover 10 for covering an opening in a torpedo car is illustrated in FIGS. 1–4. The insulating cover 10 is formed by an insulating layer 12 held between an upper wire mesh layer 14 and a lower wire mesh layer 16. The lower wire mesh layer 16 is illustrated in FIGS. 2 and 3. The insulating layer 12 may be formed of a 1" ceramic fiber blanket which may overlap the peripheral edges of the upper and lower wire mesh layers 14 and 16 as shown in FIG. 1. The upper and lower wire mesh layers may be formed of 10 gauge wire forming 6"×6" grid or mesh structure.

A pair of ferromagnetic plates 20 are positioned on the upper wire mesh layer 14. As shown in FIG. 2, each ferromagnetic plate 20 provides a lift point for lifting the insulating cover 10, such as by a pair of electromagnets 22 which can be manipulated by a crane (not shown). Each ferromagnetic plate 20 may be formed of a 12"×12" plate formed of 11 gauge steel.

A plurality of wire ties 26, shown in FIGS. 1 and 3, secure the upper wire mesh layer 14 and the lower wire mesh layer 16 together and hold the insulating layer 12 in position. As illustrated in FIG. 3, the wire ties 26 are wrapped around individual wire elements of the upper and lower wire mesh layers 14 and 16 extending through the insulating layer 12. The ends of each individual wire tie 26 are positioned to extend along the upper wire mesh layer 14 to avoid having the wire ties 26 interfere with other elements. The individual wire ties 26 may be formed of 0.080" wire.

Figure 4:
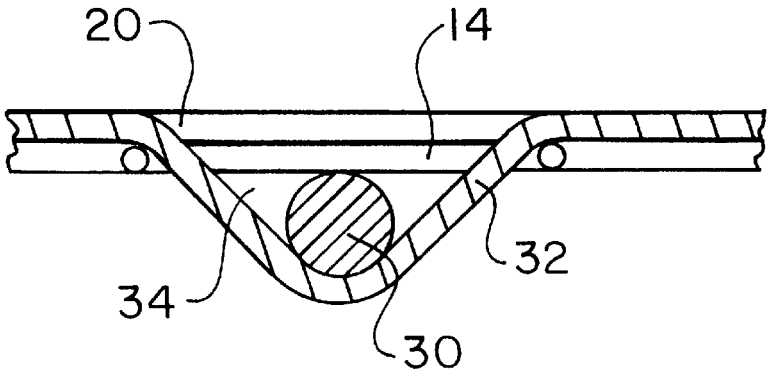
FIG. 4 is an enlarged view showing the electromagnetic plate and support rod of the insulating cover illustrated in FIGS. 1–3.

A pair of support rods 30 are positioned between the upper wire mesh layer 14 and the lower wire mesh layer 16 with the support rods 30 extending beyond the side edges of the upper and lower wire mesh layers 14 and 16. The support rods 30 are configured to have a length greater than the width of the torpedo car opening to prevent the insulating cover 10 from falling through the torpedo car opening. Specifically, each support rod 30 is positioned between one of the ferromagnetic plates 20 and the lower wire mesh layer 16. The ferromagnetic plates 20 further include a pair of support strips 32, as best illustrated in FIG. 4. Each support strip 32 extends below the upper wire mesh layer 14 and forms a locating hole 34 through which the support rod 30 extends thereby coupling each ferromagnetic plate to the upper wire mesh layer 14. The support strips 32 can be embossed in the ferromagnetic plates 20, or punched, or formed as brackets attached to the underside of the ferromagnetic plates 20, or formed in another conventional fashion. As seen in FIG. 1, wire ties 26 are provided at opposite ends of each support rod 30 to secure each support rod 30 into position.

The insulating cover 10 has a configuration with the recessed central area to better fit within the torpedo car opening. This configuration is provided by having each upper and lower wire mesh layer 14 and 16 include a pair of planar outer sections 36 and a recessed central section 38 and a pair of connecting portions 40 extending between the planar outer section 36 and the recessed central section 38 as shown in FIG. 2.

Figure 5:
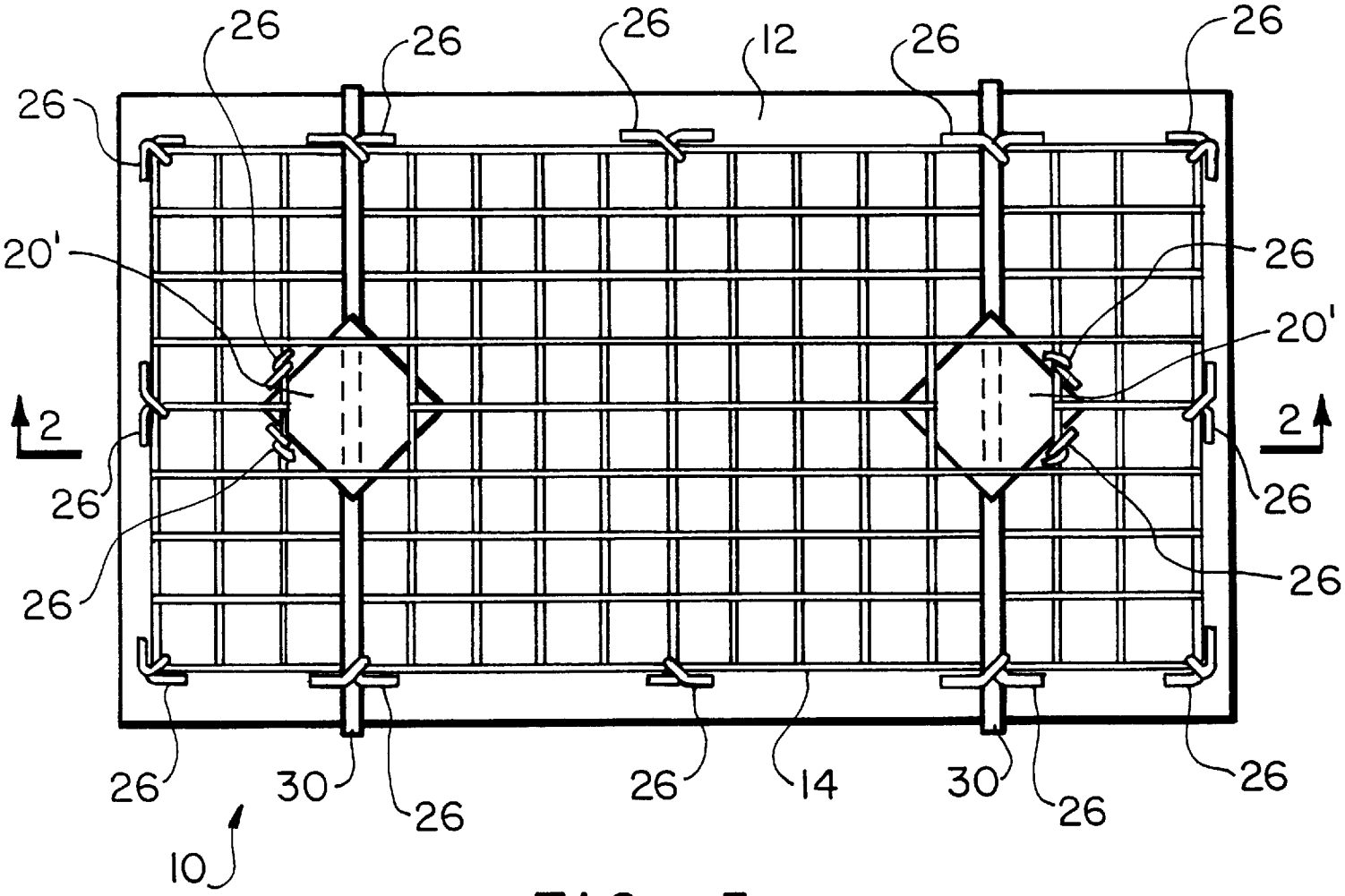
FIG. 5 is a top view of an insulating cover according to a second embodiment of the present invention.

FIG. 5 illustrates a modified insulating cover 10' according to the present invention. In the insulating cover 10', the ferromagnetic plates 20' do not include support strip 32. A portion of the upper wire mesh layer 14 is cut for each ferromagnetic plate 20' and each ferromagnetic plate 20' is positioned between the insulating layer 12 and the upper wire mesh layer 14. Further, the ferromagnetic plates 20' are positioned such that the corners or other portions of each plate 20' are overlapped by part of the upper wire mesh layer 14, as shown in FIG. 5. Additionally, as shown in FIG. 5, a pair of wire ties 26 are provided to secure the upper and lower wire mesh layers 14 and 16 together at a position adjacent the side edges of the ferromagnetic plates 20' to prevent the ferromagnetic plates 20' from moving out of position thereby coupling each ferromagnetic plate 20' to the upper wire mesh layer 14.

The insulating cover 10 of FIGS. 1–4 provides the advantages of not requiring the cutting of the upper wire mesh layer 14 during manufacture while the insulating cover 10' of FIG. 5 eliminates the need for support strips 32.

Figure 6:
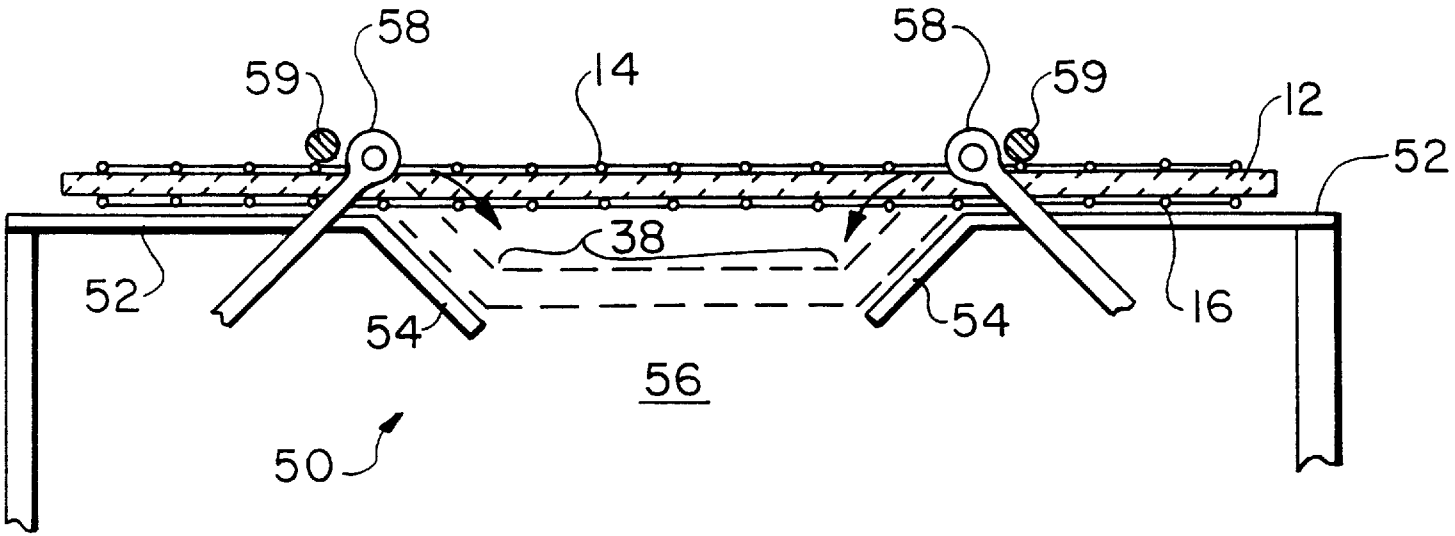
FIG. 6 schematically illustrates the bending frame for manufacturing the insulating cover illustrated in FIGS. 1–5.

The insulating covers 10 and 10' can be easily manufactured on the bending frame 50 illustrated in FIG. 6. The bending frame 50 includes a pair of side supports 52 which include downwardly tapered flanges 54 at the end of each side support 52. Flanges 54 extend into an open central area 56. A pair of bending arms 58 is provided which pivot from a point above the side supports 52 toward the open central area 56.

To manufacture the insulating covers 10 and 10', the upper and lower wire mesh layers 14 and 16 and the insulating layer 12 positioned between the upper and lower wire mesh layers 14 and 16 are positioned on the side supports 52 of the bending frame 50 below hold down bars 59 as shown in FIG. 5. The bending arms 58 will bend the upper and lower wire mesh layers 14 and 16 to form the pair of planar outer sections 36, the recessed central sections 38 and the connecting portions 40 of the upper and lower wire mesh layers 14 and 16 as shown in phantom in FIG. 5.

To manufacture the insulating cover 10', a portion of the upper wire mesh layer 14 is removed for each of the ferromagnetic plates 20' forming a pair of openings in the upper wire mesh layer 14. Each opening in the upper wire mesh layer 14 is substantially equal in size to each ferromagnetic plate 20'. Each ferromagnetic plate 20' is inserted through the corresponding opening in the upper wire mesh layer 14 to the position between the upper wire mesh layer 14 and the insulating layer 12. Each ferromagnetic plate 20' is then pivoted to position whereby the corners of the ferromagnetic plate 20' are overlapped by wire elements of the upper wire mesh layer 14. A pair of support rods 30 is inserted between the upper wire mesh layer 14 and the insulating layer 12. The upper and lower wire mesh layers 14 and 16 are secured together with a plurality of wire ties 26 which extend through the insulating layer 12 including a pair adjacent each ferromagnetic plate 20' to couple each ferromagnetic plate to the upper wire mesh layer 14. The wire ties 26 also serve to hold the support rods 30, the ferromagnetic plates 20' and the insulating layer 12 into position.

To form the insulating cover 10 of FIGS. 1–4, a pair of ferromagnetic plates 20 are positioned on top of the upper wire mesh layer 14 with support strips 32 extending through the upper wire mesh layer 14. A pair of support rods 30 is inserted between the upper wire mesh layer 14 and the insulating layer 12 through the locating holes 34 formed by the support strips 32 on the ferromagnetic plates 20. The upper and lower wire mesh layers 14 and 16 are secured together with a plurality of wire ties 26 including a pair of wire ties 26 at opposed ends of each support rod 30.

The present method provides a quick and efficient mechanism for forming a cost-effective, easily positionable insulating cover 10 or 10' for torpedo cars.

The insulating cover 10 or 10' of the present invention operates as follows. The pair of ferromagnetic plates 20 or 20' are contacted with crane mounted electromagnets 22, such as shown in FIG. 2. The electromagnets 22 are activated to securely hold the insulating cover 10 or 10'. The crane is operated to position the insulating cover 10 or 10' onto the torpedo car opening. The insulating cover 10 or 10' can be released by deactivating the electromagnets 22 and the crane subsequently moved out of position.

While particular emphasis has been placed herein on the specific embodiments illustrated in the drawings, it will be appreciated that various modifications may be made without departing from the spirit and scope of the present invention. Accordingly, the present invention is defined by the subsequent claims.

We claim:

1. An insulating cover for covering an opening in a torpedo car comprising:

an upper mesh layer and a lower mesh layer;

an insulating layer positioned between said upper and lower mesh layers;

tie means for securing said upper mesh layer and said lower mesh layer together and holding said insulating layer in position; and at least one ferromagnetic plate, whereby each said ferromagnetic plate provides a lift point for lifting said insulating cover.

2. The insulating cover of claim 1 wherein each said ferromagnetic plate is positioned on top of said upper mesh layer.

3. The insulating cover of claim 1 wherein each said ferromagnetic plate is positioned between said insulating layer and said upper mesh layer.

4. The insulating cover of claim 1 further comprising a plurality of support rods positioned between said upper mesh layer and said insulating layer extending beyond the side edges of said upper and lower mesh layers, said support rods having a length greater than the width of the opening in the torpedo car.

5. The insulating cover of claim 4 wherein a pair of said ferromagnetic plates is provided and a pair of said support rods is provided, and wherein each said support rod is positioned between one said ferromagnetic plate and said lower mesh layer.

6. The insulating cover of claim 5 wherein each said ferromagnetic plate includes at least one support strip forming a locating hole on an underside of said ferromagnetic plate, and wherein said locating hole has one said support rod extending therethrough to couple each said ferromagnetic plate to said upper mesh layer.

7. The insulating cover of claim 4 wherein said tie means further secure each said support rod into position.

8. The insulating cover of claim 7 wherein said tie means includes a plurality of wire ties extending through said insulting layer.

9. The insulating cover of claim 1 wherein said insulating layer extends beyond the peripheral edges of said upper and lower mesh layers.

10. The insulating cover of claim 9 wherein said insulating layer is a ceramic fiber material.

11. The insulating cover of claim 1 wherein said upper and lower mesh layers are substantially formed of a 6"×6" wire grid and each said ferromagnetic plate is a 12"×12" steel plate.

12. The insulating cover of claim 1 wherein said upper and lower mesh layers each includes a pair of planar outer sections and a recessed central section.

13. A method of forming an insulating cover for lowering an opening in a torpedo car, said method comprising the steps of:

a) placing a lower wire mesh layer, an upper wire mesh layer, and an insulating layer positioned between said upper and lower wire mesh layers on a bending frame;

b) bending said upper and lower wire mesh layers on said bending frame whereby each said upper and lower wire mesh layers includes a pair of planar outer sections and a recessed central section;

c) providing at least one ferromagnetic plate, whereby each said ferromagnetic plate provides a lift point for lifting said insulating cover; and d) securing said upper and lower wire mesh layers together with tie means.

14. The method of claim 13 further including, prior to said securing step, the step of inserting a plurality of support rods between said upper wire mesh layer and said insulating layer whereby said support rods extend beyond the side edges of said upper and lower wire mesh layers and wherein said support rods having a length greater than the width of the opening in the torpedo car.

15. The method of claim 13 wherein said providing of said at least one ferromagnetic plate includes the steps of i) removing a portion of said upper wire mesh layer for each said ferromagnetic plate to form an opening in said upper wire mesh layer which is at least equal to the size of said ferromagnetic plate;

ii) inserting each said ferromagnetic plate through a corresponding opening in said upper wire mesh layer to be positioned between said upper wire mesh layer and said insulating layer; and iii) turning each said ferromagnetic plate to a position wherein at least one portion of said ferromagnetic plate is overlapped by a portion of said upper wire mesh layer.

16. The method of claim 15 wherein at least one wire tie is secured to said upper and lower wire mesh layers adjacent each said ferromagnetic plate to couple each said ferromagnetic plate to said upper wire mesh layer.

17. The method of claim 13 wherein said tie means includes a plurality of wire ties which are inserted through said insulating layer.

18. The method of claim 13 wherein said providing of said at least one ferromagnetic plate includes the steps of i) positioning each said ferromagnetic plate on top of said upper wire mesh layer, wherein each said ferromagnetic plates includes at least one support strip forming a locating hole on an underside of said ferromagnetic plate with each said support strip extending below said upper wire mesh layer; and ii) inserting at least one support rod between said upper wire mesh layer and said insulating layer with one of said at least one support rod extending through each said locating hole.

19. A method of installing an insulating cover on an opening in a torpedo car, said insulating cover including an upper wire mesh layer and a lower wire mesh layer; an insulating layer positioned between said wire mesh layers; tie means for securing said upper wire mesh layer and said lower wire mesh layer together and holding said insulating layer in position; and at least one ferromagnetic plate coupled to said upper wire mesh layer, whereby each said ferromagnetic plate provides a lift point for lifting said insulating cover, said method comprising the steps of:

a) contacting each said ferromagnetic plate with a crane mounted electromagnet;

b) activating each said electromagnet to securely hold said insulating cover;

c) positioning said insulating cover on said opening using said crane; and d) deactivating said electromagnets.

* * * * *